US005869151A

United States Patent [19]

Chong

[11] Patent Number: 5,869,151

[45] Date of Patent: Feb. 9, 1999

[54] STAND

[75] Inventor: Kao Cheung Chong, Hong Kong, Hong Kong

[73] Assignee: Boto (Licenses) Limited, an Isle of Man Company of 3/F, Douglas, Isle of Man

[21] Appl. No.: 883,608

[22] Filed: Jun. 26, 1997

[51] Int. Cl.[6] ..... A47G 33/12; F16M 13/00

[52] U.S. Cl. ..... 428/18; 211/196; 248/188.7; 248/519; 428/122

[58] Field of Search ..... 211/196; 248/188.7, 248/519; 428/122, 18, 19, 20

[56] References Cited

U.S. PATENT DOCUMENTS 5,527,010 6/1996 Kao ..... 248/519

*Primary Examiner*—Henry F. Epstein
*Attorney, Agent, or Firm*—Wood, Herron & Evans, LLP

[57] ABSTRACT

A stand for supporting an elongate object such as a Christmas tree in a substantially vertical orientation has a central tubular support (4) adapted to receive an end of the object, and a plurality of legs (12) pivotally secured to the tubular support (4) so as to be movable between a retracted position and an extended position wherein the legs extend radially outwardly therefrom, and a locking collar (10) which is slidably disposed on the support (4) to engage lugs (24) on the legs (12) to secure them in the extended position.

12 Claims, 4 Drawing Sheets

STAND

FIELD OF INVENTION

The present invention relates to a stand for supporting in a substantially vertical orientation an elongate object. The invention relates in particular, but not exclusively to a stand for supporting trees, and in particular artificial Christmas trees.

DISCUSSION OF THE PRIOR ART

Stands for Christmas trees are generally provided with detachable legs so that they can be collapsed, which makes them easier to package and store at points of sale, easier to carry home when purchased, and means that after Christmas they can be collapsed and easily stored in the home. A conventional stand for artificial Christmas trees has a short central tubular member connected to the base of the trunk of the tree having slots cut therein extending from the bottom of this member, and a number of legs, usually three or four, which have corresponding grooves at an end region so that on assembly, the legs are pushed axially upwards into the slots. The slots may have detents which snap-fit over co-operating formations at the grooves. This construction does not, however, retain the legs firmly. As a second or third leg is being fitted, an earlier-fitted leg is often liable to disengage.

It has previously been proposed in applicant's U.S. Pat. No. 5,527,010 to provide a construction in which the legs are fitted to a central support by means of engagement lugs which fit in slots on the stand, and having a separate locking means, allowing the legs to be releasably secured.

The present invention seeks to provide an alternative arrangement in which the stand can be easily assembled and yet provide a stable structure.

SUMMARY OF THE INVENTION

According to the present invention there is provided a stand for supporting an elongate object in a substantially vertical orientation, comprising a central tubular support to receive an end of the object, and a plurality of legs pivotably secured on the tubular support so as to be movable between a retracted position, and an extended position in which the legs extend outwardly from the support, including a locking collar which is slidably disposed on the support to engage each of the legs to secure them in said extended position.

By pivotably connecting the legs to the support a stand which can be very easily assembled and disassembled is provided.

Preferably, the legs have a proximal end at which they are pivotably connected to the support at a proximal end thereof, the pivotal connection being provided at a lower region of the proximal end. At an upper region of the proximal end of each leg there is provided a lug upstanding therefrom over which the locking collar is slidably engagable, in order to lock the upper region of the leg against the central support.

The locking collar preferably comprises a short central tubular sleeve portion which overlies the upstanding lugs when moved to engage the lugs.

The central tubular support preferably has an outwardly extending flange portion at its lowermost region from which extend a plurality of protruding portions, one for each leg, to which the legs are attached. The legs are preferably channel-shaped of inverted U-shaped section, opposed walls of the channel engaging opposite sides of the protruding portions.

The central support is preferably provided at its upper end with a gripping portion having means defining a central aperture for receiving in use the end of the elongate object, the said means being resiliently deformable in order to provide a tight fit with the object inserted therein. The said means include a plurality of axially extending fingers depending from an upper lip of the gripping portion separated by recesses, so as to allow a degree of outward bending as the object is inserted therein. The gripping portion is preferably a separate collar part which can be fitted on and removed from the end of the support, the support including an L-shaped slot therein having an axial portion, and a circumferential portion, the collar having a locating lug which in use is engaged in the slot by a push and twist action of the collar. The collar includes an aperture above the locating lug for viewing the lug as it is inserted into the slot.

The invention also resides in a stand as described above, in combination with an artificial tree.

BRIEF DESCRIPTION OF THE DRAWINGS

Embodiments of the present invention are now described, by way of example only, with reference to the following drawings in which:

FIG. 1(*b*) Is a side view of the assembled stand of FIG. 1(*a*);

FIG. 2(*b*) Is a side view of the assembled stand of FIG. 2(*a*);

FIG. 3(*b*) Shows the locking collar and gripping collar fitted on the central support;

FIG. 3(*c*) Illustrates the upward pivoting of a leg;

FIG. 3(*d*) Illustrates the final assembly step in securing the legs in position.

DETAILED DESCRIPTION OF THE PREFERRED EMBODIMENT

Figure 1A:
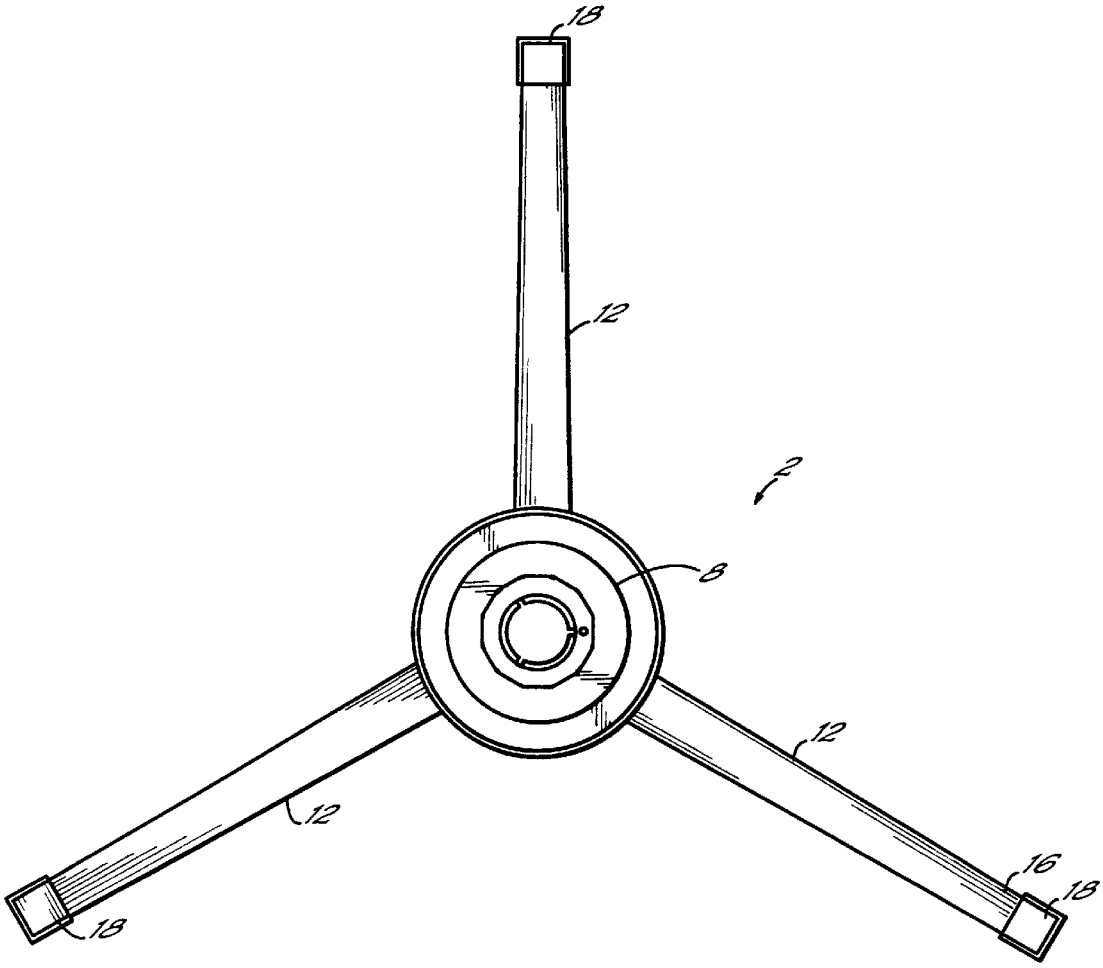
FIG. 1(*a*) Is a plan view of an assembled stand in accordance with a first embodiment of the invention.
Figure 1B:
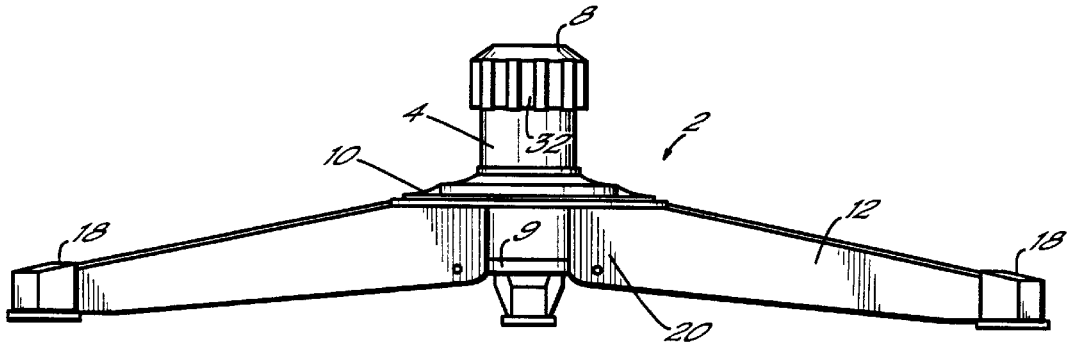

Referring to FIG. 1, this shows an assembled stand, generally designated 2. The stand comprises a tubular central support part 4 having an apertured base part 6 (see FIG. 4) fitted thereto which in use receives a tapered bottom part of the tree trunk 7. The base part 6 has an outwardly extending flange portion 9, from which extend a number of protruding lugs 15 to which the legs 12 are attached, one being provided for each leg 12. The support 4 is provided at an upper region with a gripping collar 8 which in use grips the trunk, as is discussed in more detail below. The support 4 is also provided with a locking collar 10 which, as best seen in FIG. 4, has a short central tubular portion 11 and an outwardly flaring frustoconnical skirt portion 13.

Figure 2A:
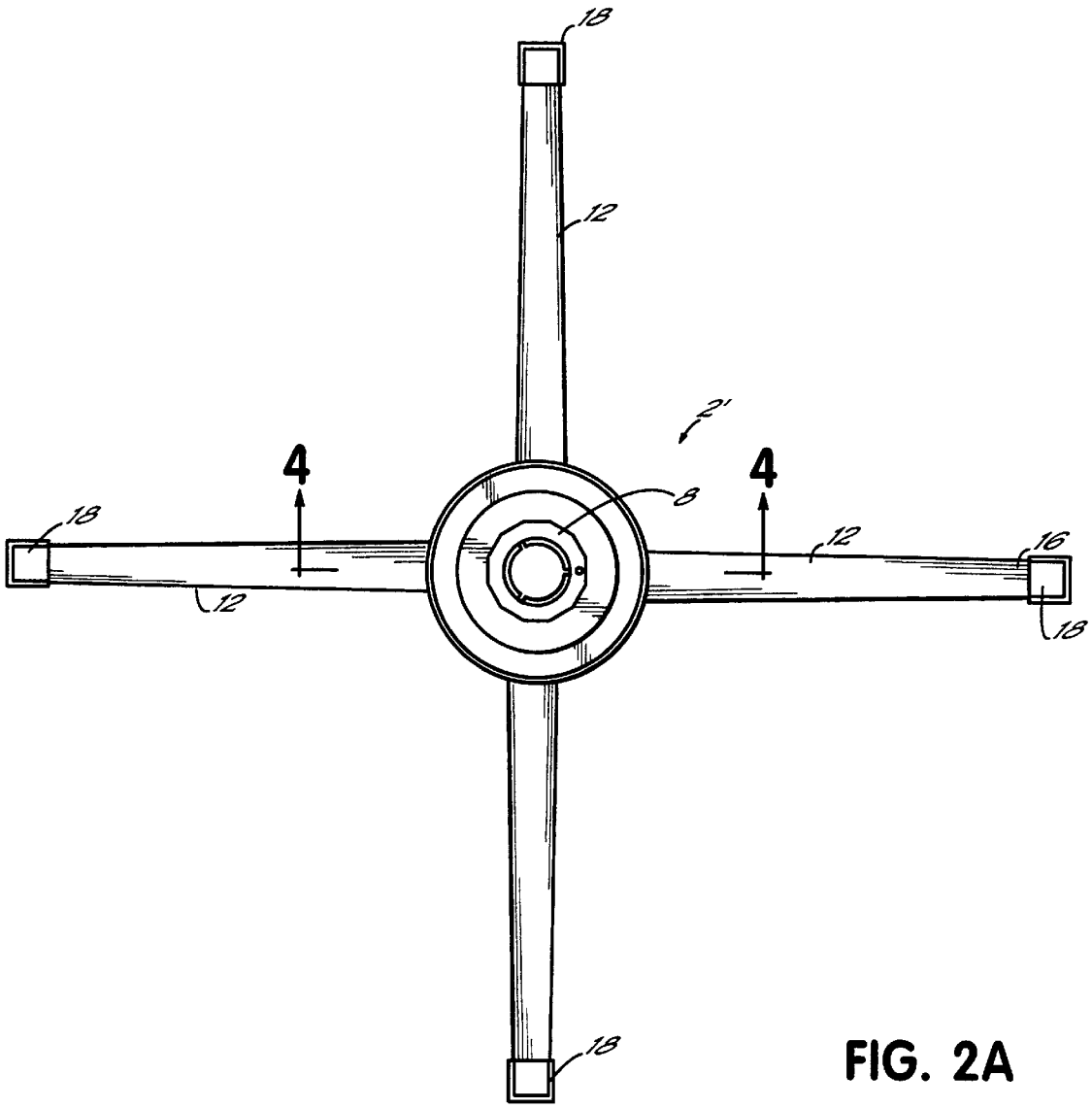
FIG. 2(*a*) Is a plan view of an assembled stand in accordance with a second embodiment of the invention.
Figure 2B:
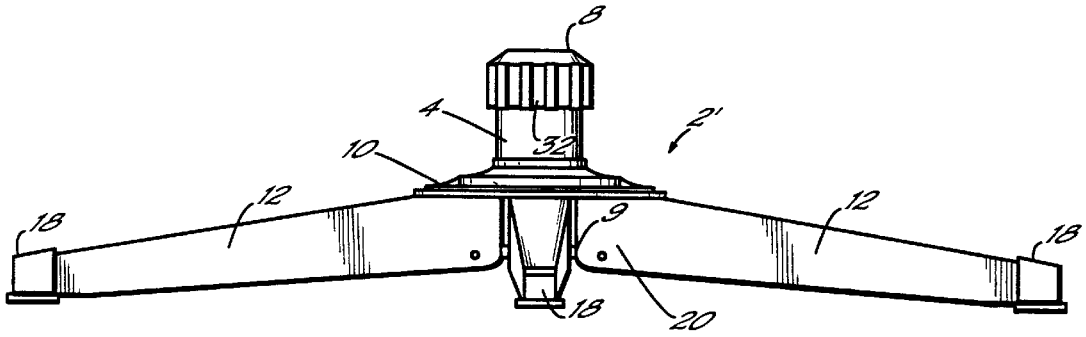
Figure 3D:
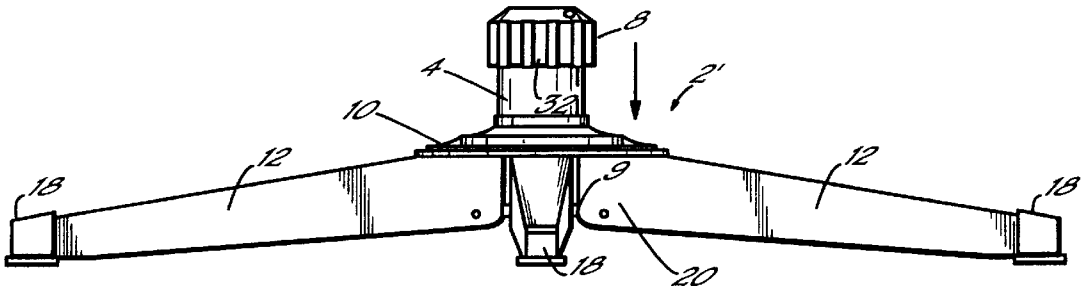
FIG. 3(*a*) Illustrates the sequence of steps of assembly of a central support, locking collar and gripping collar.
Figure 3C:
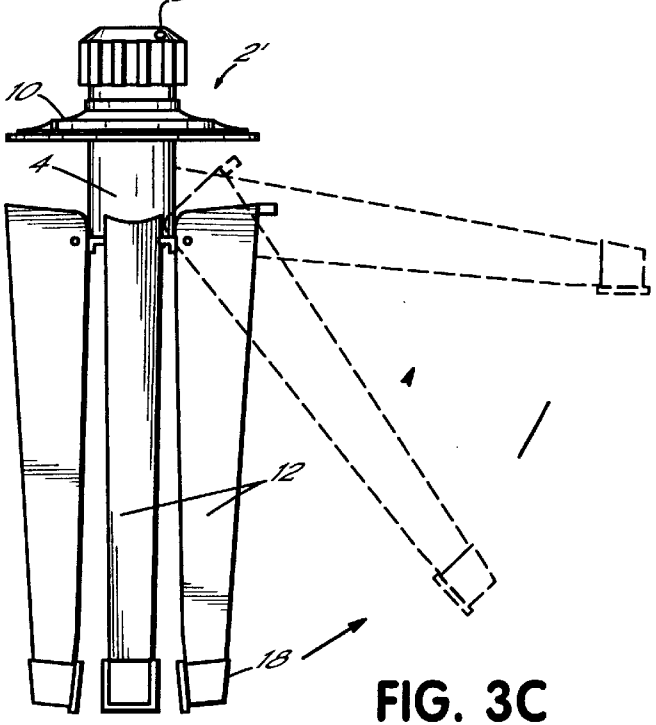
Figure 3B:
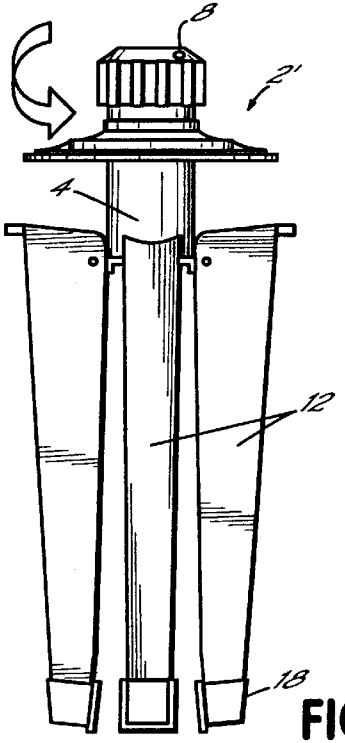
Figure 3A:
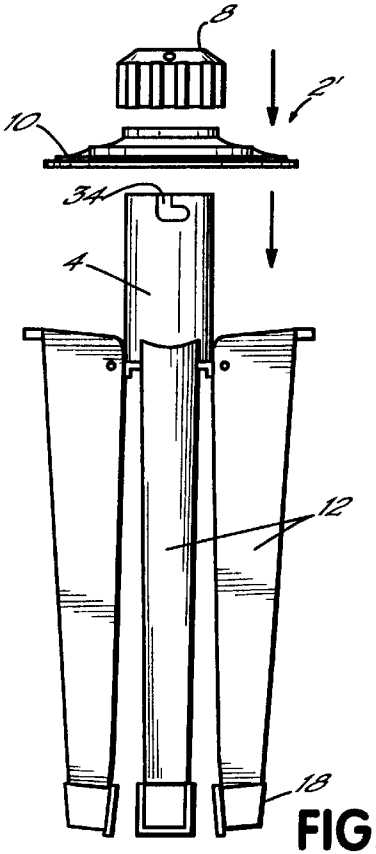

The embodiment of FIG. 1 has three legs, whilst that of FIG. 2 has four legs, although it will be appreciated that a greater number could be provided if desired. Each leg 12 is a channel-shaped member of inverted U-shaped section which tapers in depth from the proximal end attached to the support towards the ground-engaging end 16. The ground-engaging distal end 16 of each leg is provided with a detachable foot 18, preferably of plastics material.

Figure 4A:
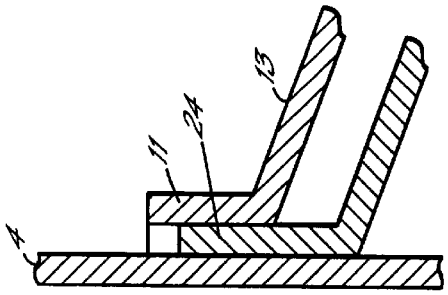
FIG. 4 is a sectional view taken along the line A—A of FIG. 2(*a*).
Figure 4:
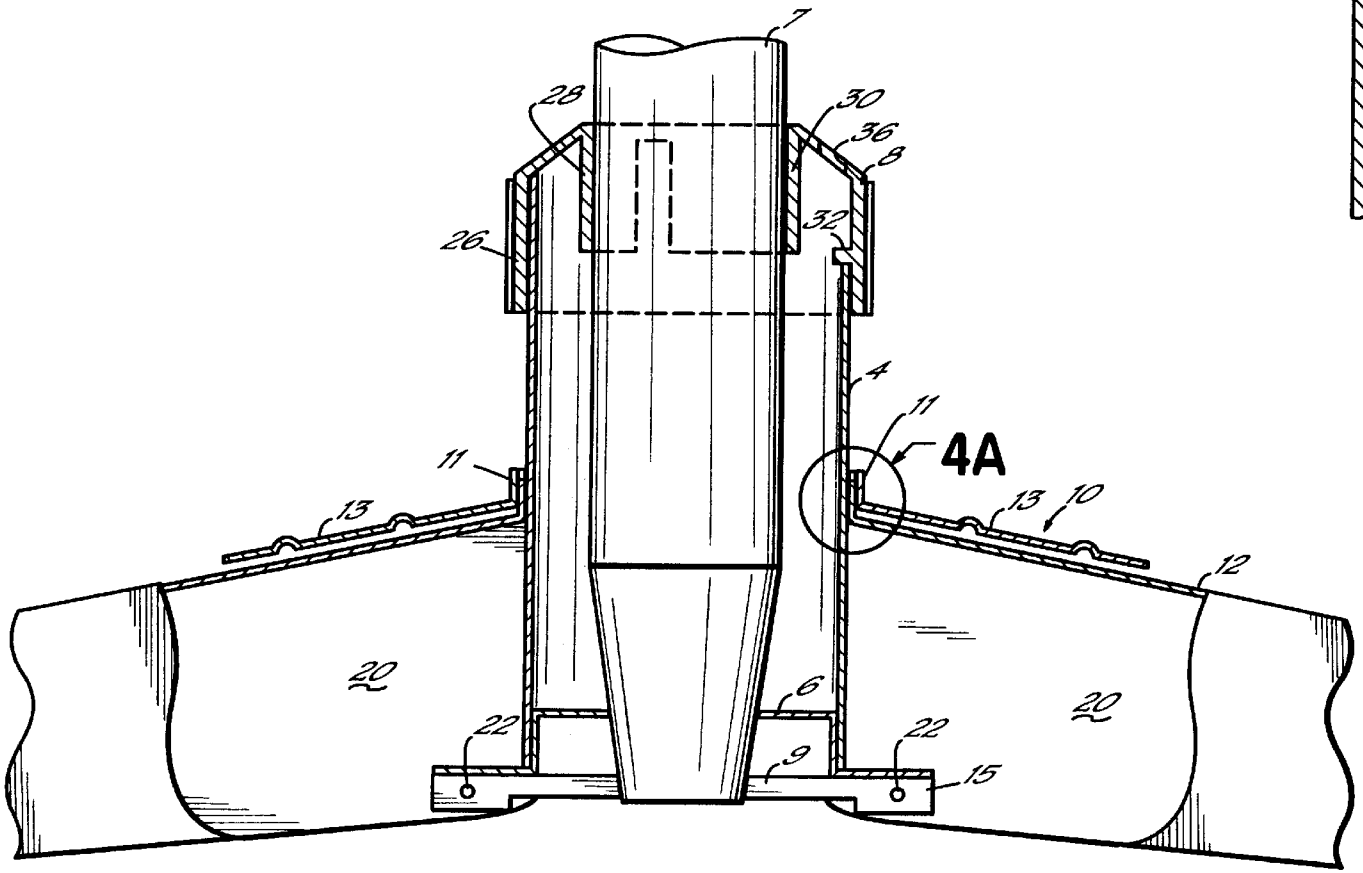

As best seen in FIG. 4, each leg 12 is pivotably connected to the support 4 at a lower region of the leg. More specifically, for each leg the opposed faces 20 of the U-shaped section of the legs abut opposite faces of the protruding lugs 15. A bolt or rivet 22 extends through aligned apertures in the legs 12 and lugs 15. An upper region of each leg 12 is formed with an upwardly extending projection or lug 24 which is curved to match the curved outer surface of the support part 4, and which in use is locked against the support part 4 by the locking collar 10, as will be discussed further below.

The gripping collar 8 is a tubular member provided with an outer depending skirt portion 26 of internal diameter only slightly larger than the external diameter of the support 4, and a plurality of inner depending finger-like portions 28 separated by recesses 30, whereby the portions 28 can flex outwardly slightly, assisting the insertion of the tree trunk 7, and providing a tight fit with the tree trunk. The collar 8 is preferably formed of a plastics material. The outer surface of the skirt portion 26 is provided with ridges 32 to allow the collar 8 to be easily gripped by a user.

The skirt portion 26 is also provided with a locating lug 32 which in use engages in a slot 34 (see FIG. 3(*a*)) in the top of the support 4. An inspection aperture 36 located above the lug 32 allows the user to see the lug 32 as the gripping collar 8 is fitted on the support 4 to assist in locating the slot 34.

The operation of assembly of the stand is carried out in the manner now described with reference to FIG. 3. Firstly, the locking collar 10 and gripping collar 8 are aligned with the end of the support, the gripping collar 8 being orientated so that the lug 32 is aligned with the slot 34, and are push-fitted thereon, as shown in FIG. 3(*a*). The collar 8 is then rotated as indicated by the arrow so that the lug 32 moves around the circumferential portion of the slot, from which position it cannot be pulled off, as indicated in FIG. 3(*b*). The legs 12 are then pivoted upwardly in the manner as shown in FIG. 3(*c*) until the legs are extended outwardly and generally perpendicularly to the axis of the tubular support 4 with the lugs 24 abutting the central support 4. When all the legs 12 have been pivoted in this manner, the locking collar 10 is pushed down, as shown in FIG. 3(*d*), so that the central tubular portion 11 overlies the lugs 24 (as best seen in the inset of FIG. 4) thereby locking the legs in position. The stand is now assembled, and the trunk of the tree can now be push-fitted into the gripping collar 8.

What is claimed is:

1. A stand for supporting an elongate object in a substantially vertical orientation, comprising a central tubular support to receive an end of the object, a plurality of legs pivotably secured on the tubular support so as to be movable between a retracted position and an extended position in which the legs extend outwardly from the support, and a locking collar which is slidably disposed on the support to engage each of the legs to secure them in said extended position.

2. A stand according to claim 1 wherein the legs have a proximal end at which they are pivotably connected to the support at a proximal end thereof, the pivotal connection being provided at a lower region of the proximal end.

3. A stand according to claim 2 wherein at an upper region of the proximal of each leg, there is provided a lug upstanding therefrom over which the locking collar is slidably engagable, in order to lock the upper region of the leg against the central support.

4. A stand according to claim 3 wherein the locking collar comprises a short central tubular sleeve portion which overlies the upstanding lugs when moved to engage the lugs.

5. A stand according to claim 1, wherein the central tubular support has an outwardly extending flange portion at its lowermost region from which extend a plurality of protruding portions, one for each leg, to which the legs are attached.

6. A stand according to claim 5, wherein the legs are channel-shaped of inverted U-shape section, opposed walls of the channel engaging opposite sides of the protruding portions.

7. A stand according to claim 1 wherein the central support is provided at its upper end with a gripping portion having means defining a central aperture for receiving in use the end of the elongate object, the said means being resiliently deformable in order to provide a tight fit with the object inserted therein.

8. A stand according to claim 7 wherein said means include a plurality of axially extending fingers depending from an upper lip of the gripping portion separated by recesses, so as to allow a degree of outward bending as the object is inserted therein.

9. A stand according to claim 1 wherein the gripping portion is a separate collar part which can be fitted on and removed from the end of the support, the support including an L-shaped slot therein having an axial portion, and a circumferential portion, the collar having a locating lug which in use is engaged in the slot by a push and twist action of the collar.

10. A stand according to claim 9 wherein the collar includes an aperture above the locating lug for viewing the lug as it is inserted into the slot.

11. A stand according to claim 1 in combination with an artificial tree.

12. A stand for supporting an elongate object in a substantially vertical orientation, comprising a central tubular support to receive an end of the object, a plurality of legs permanently secured in a pivotable manner on the tubular support so as to be movable between a retracted position in which the legs lie generally parallel to the axis of the central tubular support, and an extended position in which the legs extend outwardly from the support, and a locking collar which is slidably disposed on the support to engage each of the legs to secure them in said extended position.

* * * * *